US008356724B2

(12) United States Patent
Kardos et al.

(10) Patent No.: US 8,356,724 B2
(45) Date of Patent: Jan. 22, 2013

(54) EXPANSION TANK

(75) Inventors: Zoltan Kardos, Södertälje (SE); Erik Söderberg, Stockholm (SE)

(73) Assignee: Scania CV AB (SE)

( * ) Notice: Subject to any disclaimer, the term of this patent is extended or adjusted under 35 U.S.C. 154(b) by 0 days.

(21) Appl. No.: 13/128,306

(22) PCT Filed: Nov. 9, 2009

(86) PCT No.: PCT/SE2009/051273

§ 371 (c)(1),
(2), (4) Date: May 9, 2011

(87) PCT Pub. No.: WO2010/059106

PCT Pub. Date: May 27, 2010

(65) Prior Publication Data

US 2011/0210125 A1 Sep. 1, 2011

(30) Foreign Application Priority Data

Nov. 21, 2008 (SE) ..... 0802445

(51) Int. Cl.
*B65D 43/26* (2006.01)

(52) U.S. Cl. ..... 220/264; 220/262; 220/263

(58) Field of Classification Search ..... 220/562–564
See application file for complete search history.

(56) References Cited

U.S. PATENT DOCUMENTS 3,752,132 A * 8/1973 Bentz et al. ..... 123/563
3,992,894 A 11/1976 Antonetti et al.
4,049,047 A 9/1977 Keen
6,390,318 B1 * 5/2002 Tanaka et al. ..... 220/203.26

FOREIGN PATENT DOCUMENTS

WO WO 03/042516 A2 5/2003

OTHER PUBLICATIONS

International Search Report dated Mar. 10, 2010, issued in corresponding international application No. PCT/SE2009/051273.

* cited by examiner

*Primary Examiner* — J. Gregory Pickett
*Assistant Examiner* — James M Van Buskirk
(74) *Attorney, Agent, or Firm* — Ostrolenk Faber LLP

(57) ABSTRACT

An expansion tank (28) comprising a passage (34) with a an inlet aperture (34*a*) for liquid replenishment of the expansion tank (28), a cover (32) which in a non-fitted state leaves the passage (34) clear and in a fitted state closes the passage (34), and a first expansion chamber (29) for receiving liquid which circulates in a first system (A). The expansion tank (28) includes a second expansion chamber (30) for receiving liquid which circulates in a second system (B) and said passage (34) divides, at a distance from the inlet aperture (34*a*), into a first branch (34*b*) which leads liquid to the first expansion chamber (29) and a second branch (34*c*) which leads liquid to the second expansion chamber (30).

13 Claims, 3 Drawing Sheets

EXPANSION TANK

CROSS-REFERENCE TO RELATED APPLICATIONS

The present application is a 35 U.S.C. §§371 national phase conversion of PCT/SE2009/051273, filed Nov. 9, 2009, which claims priority of Swedish Application No. 0802445-7, filed Nov. 21, 2008, the contents of which are incorporated by reference herein. The PCT International Application was published in the English language.

BACKGROUND TO THE INVENTION AND STATE OF THE ART

The present invention relates to an expansion tank with plural expansion chambers.

The amount of air which can be supplied to a supercharged combustion engine depends on the pressure of the air but also on the temperature of the air. Supplying as large an amount of air to the combustion engine as possible entails effective cooling of the air before it is led to the combustion engine. Effective cooling of the charge air may be achieved by subjecting it to two steps of cooling. The charge air may be subjected to a first step of cooling in a first charge air cooler by coolant from the combustion engine's cooling system. This first step may cool the charge air to a temperature close to the temperature of the coolant. The charge air may thereafter be subjected to a second step of cooling in a second charge air cooler by coolant from a low-temperature cooling system. The charge air may thus be cooled to a temperature close to the temperature of the surroundings.

The technique known as EGR (exhaust gas recirculation) is a known way of recirculating part of the exhaust gases from a combustion process in a combustion engine. The recirculating exhaust gases are mixed with the charge air before it is led to the cylinders of the combustion engine. Adding exhaust gases to the air causes a lower combustion temperature resulting inter alia in a reduced content of nitrogen oxides $NO_x$ in the exhaust gases. This technique is used both for Otto engines and for diesel engines. Supplying a large amount of exhaust gases to the combustion engine entails here again effective cooling of the exhaust gases before they are led to the combustion engine. The exhaust gases may likewise be cooled in two stages. They may be subjected to a first step of cooling in a first EGR cooler by coolant from the combustion engine's cooling system and a second step of cooling in a second EGR cooler by coolant from the low-temperature cooling system. Thus the exhaust gases too may be cooled to a temperature close to the temperature of the surroundings.

Cooling of charge air and recirculating exhaust gases in two stages as above entails using two separate cooling systems. The coolants in the respective cooling systems are of the same kind but have different working temperatures during operation. It is therefore not appropriate for the coolants to be mixed. The coolants become warmer during operation in the respective cooling systems, which means that they assume a larger volume. To cater for coolant volume change, each cooling system has its own expansion tank. On the occasion of servicing, the coolant levels in the respective expansion tanks in the cooling systems are checked and replenished as necessary.

SUMMARY OF THE INVENTION

The object of the present invention is to provide an expansion tank which can be used for servicing and liquid replenishment of two separate systems.

This object is achieved with the arrangement of the invention. It is assumed that the same type of liquid is used in both systems. The expansion tank comprises two expansion chambers which are used for receiving coolant in two separate systems. The expansion tank comprises a passage with an inlet aperture for liquid replenishment of the respective expansion chambers. The passage has with advantage a slope downwards from the inlet aperture so that the liquid runs through the passage by force of gravity. The liquid runs initially through a common portion of the passage. At a distance from the inlet aperture, the passage divides into a first branch which leads liquid to the first expansion chamber and a second branch which leads liquid to the second expansion chamber. Such a passage makes it possible to replenish expansion chambers of two different systems at the same time with liquid from a single point.

According to an embodiment of the invention, the expansion tank comprises a wall element which constitutes a dividing wall between the first expansion chamber and the second expansion chamber. Such a dividing wall effects a simple and functional division of the space existing in the expansion tank into a first expansion chamber and a second expansion chamber. The expansion tank may comprise a wall portion which protrudes into the passage so that the first branch is formed on one side of the wall portion and the second branch is formed on an opposite side of the wall portion. In cases where the passage takes the form of, for example, a filling pipe, simple branching of the passage is achieved by a suitably shaped such wall portion which protrudes in at a lower end of the filling pipe. The filling pipe has here an extent from an upper end at the inlet aperture to the lower end. With advantage, the wall portion which divides the passage into the first branch and the second branch constitutes part of said wall element. The wall element which constitutes a dividing wall between the expansion chambers may here have a suitably shaped upper portion which extends into the filling pipe. Branching of the passage is thus achieved in an uncomplicated manner.

According to another preferred embodiment of the invention, the passage divides into the first branch and the second branch at a height level which corresponds to a maximum level for the liquid in the first expansion chamber and a maximum level for the liquid in the second expansion chamber. When liquid is added via the common inlet aperture, one of the expansion chambers usually reaches a maximum liquid level before the other. The aforesaid positioning of the branching at a point which is level with the maximum levels for the liquid in the respective expansion chambers results in the branch which leads liquid to an already sufficiently filled expansion chamber being also completely full of liquid. Liquid can therefore only continue to be led, via the second branch, to the not yet sufficiently filled second expansion chamber. The liquid replenishment process continues until the liquid level in the second expansion chamber also reaches the maximum level.

According to another preferred embodiment of the invention, the cover comprises a closure element adapted to closing the first branch and/or the second branch when the cover is in the fitted state. As the cover in the fitted state closes at least one of said branches, there can be no transfer of liquid between the two branches, nor consequently between the two expansion chambers, when the systems are in operation. The two systems are thus completely separated from one another when the cover is in the fitted state. The closure element may comprise a contact surface adapted to coming into contact with at least a contact surface which defines an inlet aperture to the first branch and/or a contact surface which defines an inlet aperture to the second branch when the cover is in the fitted state. Appropriate configuration of said contact surfaces will result in good closure of the first branch and/or the second branch when the cover is in the fitted state. The expansion tank comprises with advantage at least one seal element which defines at least one of said contact surfaces. Such a seal element may be made of an elastic material, e.g. a rubber material. Very reliable closing of the first branch and/or the second branch may thus be achieved.

According to another preferred embodiment of the invention, the closure element is adapted to closing the first branch and/or the second branch with a flexible force. It is possible to use for the purpose a spring means applied in such a way that it presses the closure element against a contact surface with a spring force when the cover is in the fitted state. If the pressure in either of the expansion chambers rises to a level above a highest acceptable value, the closure element may lift against the action of the spring means so that the pressure within the expansion chamber is reduced. When the pressure in the expansion chamber is reduced to an acceptable level, the spring means will reclose the closure element.

According to another preferred embodiment of the invention, the liquid is a coolant intended to circulate in two separate cooling systems in which the coolants in the respective cooling systems are intended to be at different working temperatures during operation. One cooling system may be a cooling system which cools a combustion engine and the other cooling system may be a low-temperature cooling system in which the coolant will have a significantly lower working temperature than the coolant in the combustion engine's cooling system.

BRIEF DESCRIPTION OF THE DRAWINGS

A preferred embodiment of the invention is described below by way of example with reference to the attached drawings, in which.

DETAILED DESCRIPTION OF A PREFERRED EMBODIMENT OF THE INVENTION

Figure 1:
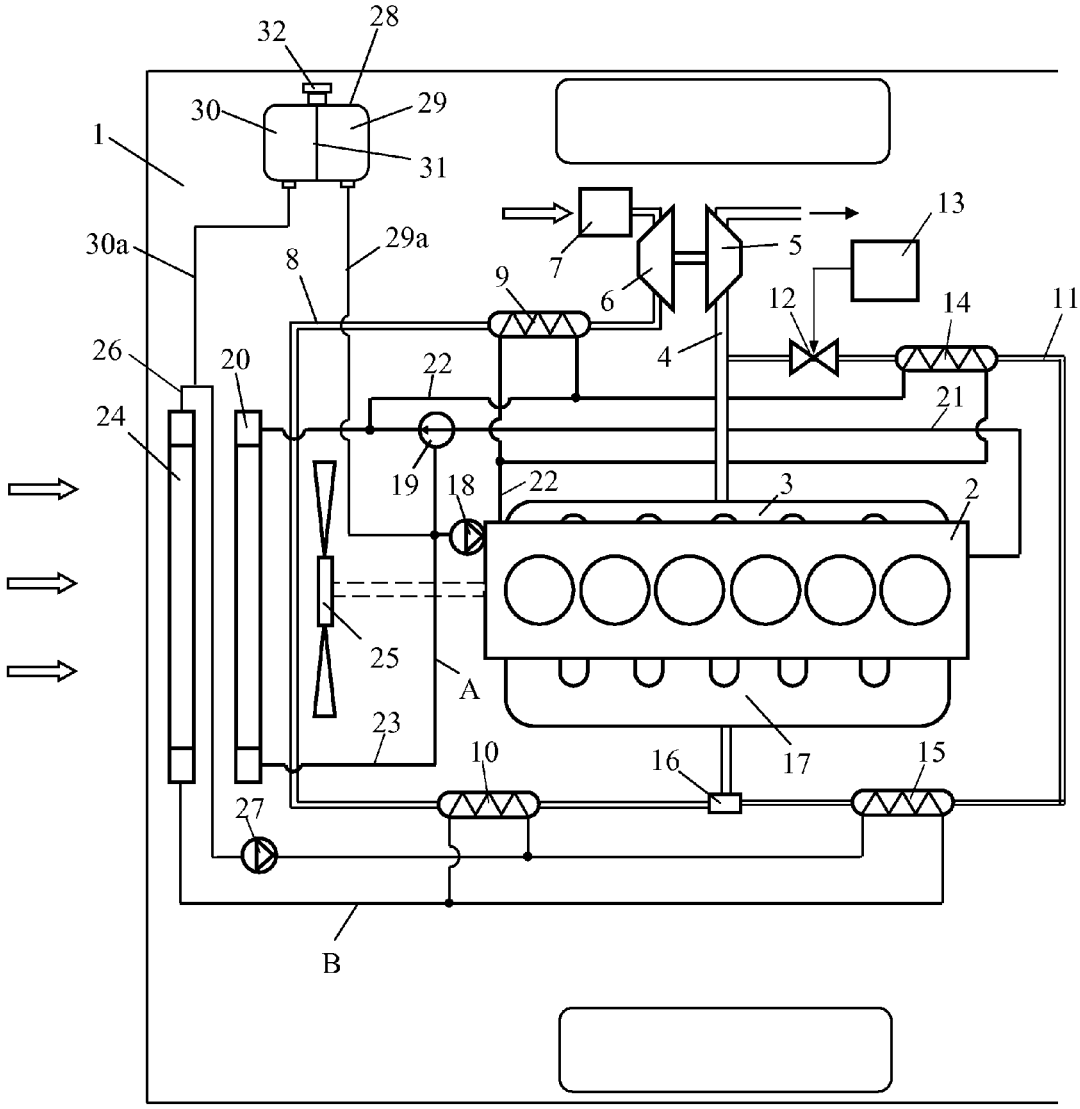
FIG 1 depicts a vehicle with two cooling systems and an expansion tank according to the present invention.

FIG 1 depicts schematically a vehicle 1 powered by a supercharged combustion engine 2. The vehicle 1 is with advantage a heavy vehicle. The combustion engine is here exemplified as a diesel engine 2. The exhaust gases from the cylinders of the diesel engine 2 are led via an exhaust manifold 3 to an exhaust line 4. The diesel engine 2 is provided with a turbo unit which comprises a turbine 5 and a compressor 6. The exhaust gases in the exhaust line 4, which will be at above atmospheric pressure, are led initially to the turbine 5. The turbine 5 is thereby provided with driving force which is transferred, via a connection, to the compressor 6. The compressor 6 thereby compresses air which is drawn into an air inlet line 8 via an air filter 7. The air in the inlet line 8 is subjected to a first step of cooling in a first charge air cooler 9 by coolant from the combustion engine's cooling system A. The compressed air is thereafter subjected to a second step of cooling in a second charge air cooler 10 by coolant from a low-temperature cooling system B.

A return line 11 for effecting recirculation of part of the exhaust gases in exhaust line 4 has an extent between the exhaust line 4 and the inlet line 8. The return line 11 comprises an EGR valve 12 by which the exhaust flow in the return line 11 can be controlled. A control unit 13 is adapted to controlling the EGR valve 12 on the basis of information about the current operating state of the diesel engine 2. The return line 11 comprises a first EGR cooler 14 for subjecting the exhaust gases to a first step of cooling. The exhaust gases are cooled in the first EGR cooler 14 by coolant from the combustion engine's cooling system A. The exhaust gases are subjected to a second step of cooling in a second EGR cooler 15 by coolant from the low-temperature cooling system B. The cooled recirculating exhaust gases and the cooled air are mixed in a mixing device 16 before the mixture is led to the respective cylinders of the diesel engine 2 via a manifold 17.

The combustion engine 2 is cooled by coolant which circulates in the cooling system A. A coolant pump 18 circulates the coolant in the cooling system A. A main flow of coolant is led through the combustion engine 2. After the coolant has cooled the combustion engine 2, it is led in a line 21 to a thermostat 19 in the cooling system. When the coolant has reached a normal operating temperature, the thermostat 19 is adapted to leading the coolant to a radiator 20 fitted at a forward portion of the vehicle, in order to be cooled. A smaller portion of the coolant in the cooling system is not led to the combustion engine 2 but is circulated through a line circuit 22 which leads coolant to the first charge air cooler 9, in which it subjects the compressed air to a first step of cooling, and to the first EGR cooler 14, in which it subjects the recirculating exhaust gases to a first step of cooling.

The low-temperature cooling system B comprises a radiator element 24 fitted in front of the radiator 20 in a peripheral region of the vehicle 1. In this case the peripheral region is situated at a front portion of the vehicle 1. A radiator fan 25 is adapted to generating a flow of surrounding air through the radiator element 24 and the radiator 20. As the radiator element 24 is situated in front of the radiator 20, the coolant in the radiator element 24 is cooled by air at the temperature of the surroundings. The coolant in the radiator element 24 may thus be cooled to a temperature close to the temperature of the surroundings. The cold coolant from the radiator element 24 is circulated in the low-temperature cooling system B in a line circuit 26 by means of a pump 27. The line circuit 26 leads coolant to the second charge air cooler 10, in which it subjects the compressed air to a second step of cooling, and to the second EGR cooler 15, which subjects the recirculating exhaust gases to a second step of cooling.

During operation of the diesel engine 2, the coolant in the combustion engine's cooling system A will have a working temperature of about 80-90° C. The coolant in the combustion engine's cooling system A therefore cools both the charge air of the combustion engine 2 in the first charge air cooler 9 and the recirculating exhaust gases in the first EGR cooler 14. The coolant in the low-temperature cooling system B may have a working temperature of about 30-50° C. The temperature of the coolant in the low-temperature cooling system B will vary with the temperature of the surrounding air but will substantially always be at a significantly lower temperature than the temperature of the coolant in the combustion engine's cooling system A. The coolant in the low-temperature cooling system B thus cools the air in the second charge air cooler 10 and the recirculating exhaust gases in the second EGR cooler 15.

The volume of the coolants in the cooling systems A, B will increase as they become warm. The present invention uses a common expansion tank 28 to absorb the varying volume of the coolants in the respective cooling systems A, B. The expansion tank 28 comprises a first expansion chamber 29 for the coolant in the combustion engine's cooling system A. The first expansion chamber 29 is connected to the combustion engine's cooling system A by a line 29*a*. The expansion tank 28 comprises a second expansion chamber 30 for the coolant in the low-temperature cooling system B. The second expansion chamber 30 is connected to the low-temperature cooling system B by a line 30*a*. A dividing wall 31 within the expansion tank 28 separates the expansion chambers 29, 30 from one another. The expansion tank 28 comprises, at an upper portion, a removable cover 32 to allow coolant replenishment of the cooling systems A, B.

Figure 2:
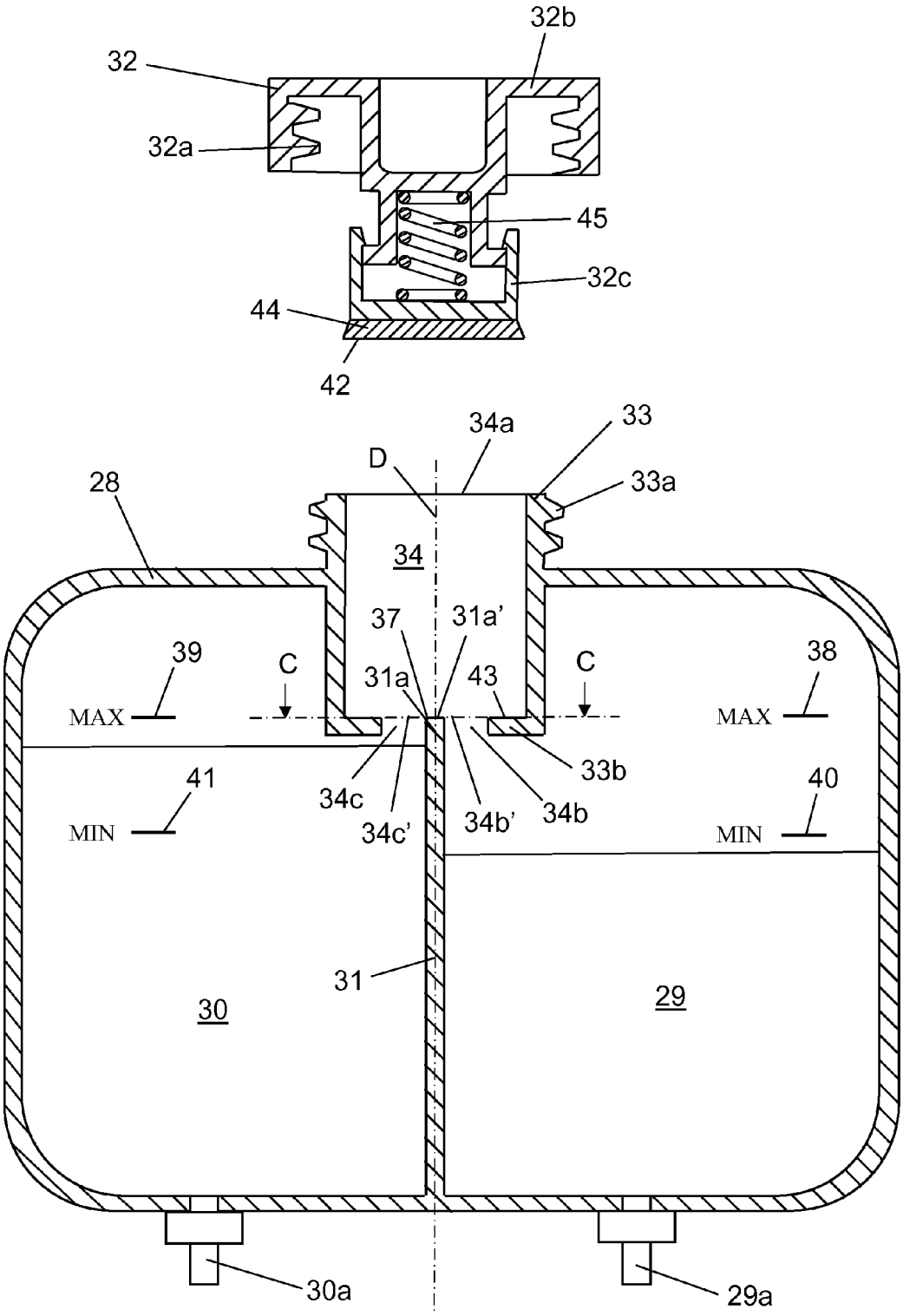
FIG 2 depicts the expansion tank in FIG 1 with a cover in a non-fitted state.

FIG 2 depicts the expansion tank 28 in more detail. The lines 29*a*, 30*a* are connected to the respective expansion chambers 29, 30 at a lower wall portion of the expansion tank 28 when it is in a fitted state in the vehicle 1. A filling pipe 33 is provided at an upper wall portion of the expansion tank 28. The filling pipe 33 defines an internal duct 34 for coolant replenishment of the expansion tank 28. The cover 32 is provided with an internal thread 32*a* adapted to cooperating with an external thread 33*a* of the filling pipe 33 so that the cover 32 can be screwed onto and unscrewed from the filling pipe 33. The passage 34 comprises an inlet aperture 34*a* which is left clear when the cover 32 is unscrewed from the filling pipe 33. The wall element 31 has a main extent in a plane D which extends through the passage 34. An upper portion 31*a* of the wall element 31 protrudes somewhat into the filling pipe 33. The shape of the upper portion 31*a* of the wall element is such that it divides a lower section of the passage 34 into a first branch 34*b* and a second branch 34*c*. The upper wall portion 31*a* has an edge surface 31*a*' situated between an inlet aperture 34*b*' to the first branch 34*b* and an inlet aperture 34*c*' to the second branch 34*c*. The first branch 34*b* is connected to the first expansion chamber 29 and the second branch 34*c* is connected to the second expansion chamber 30.

The expansion chambers 29, 30 are provided with markings which represent maximum coolant levels 38, 39 in the respective expansion chambers 29, 30 and minimum coolant levels 40, 41 in the respective expansion chambers 29, 30. The maximum level 38 for the coolant in the first expansion chamber 29 and the maximum level 39 for the coolant in the second expansion chamber 30 are situated at the same level in the expansion tank 28. The maximum levels 38, 39 for the coolant in the expansion chambers 29, 30 are situated at the same height level 37 as the edge surface 31*a*' of the upper wall portion. The cover 32 comprises a closure element in the form of a seal element 44. The seal element 44 is with advantage made of a material with elastic characteristics, e.g. a rubber material. The seal element 44 has in this case a substantially planar contact surface 42 adapted to coming into contact with the edge surface 31*a*' of the upper wall portion and a contact surface 43 of the filling pipe 33 when the cover 32 is in a fitted state. The filling pipe's contact surface 43 is defined by a portion 33*b* directed radially inwards and situated at a lower end of the filling pipe 33. The cover 32 comprises a base portion 32*b* and a front portion 32*c* which is movable relative to the base portion 32*b*. A spring means 45 is fitted in a space between the base portion 32*b* and the front portion 32*c* in order to keep the front portion 32*c* in a predetermined position relative to the base portion 32*b* by spring force. The seal element 44 forms part of the front portion 32*c*.

Figure 3:
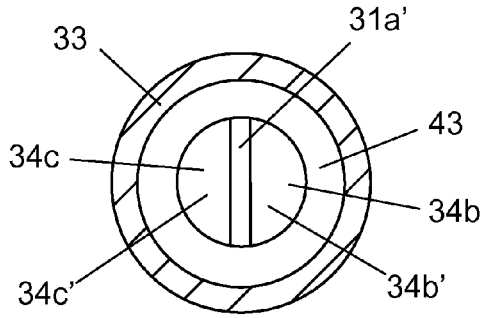
FIG 3 depicts a cross-sectional view of the expansion tank in FIG 2 in the plane C-C.

FIG 2 depicts the expansion tank 28 in a servicing situation. The coolant level in the first expansion chamber 29 is here below the minimum level 40. The combustion engine's cooling system A therefore needs replenishing with coolant. In contrast, the coolant level in the second expansion chamber 30 is acceptable because it is between the maximum level 39 and the minimum level 41. The cover 32 is here in a non-fitted state so that the expansion tank 28 can be replenished with coolant. FIG 3 depicts a cross-sectional view through the plane C-C in FIG 2. The plane C-C is situated at the height level 37. This diagram shows that the inlet aperture 34*b*' to the first branch 34*b* and the inlet aperture 34*c*' to the second branch 34*c* are defined by the edge surface 31*a*' of the upper wall portion and the contact surface 43 of the filling pipe 33. Coolant put into the filling pipe 33 is led downwards in the passage 34 by force of gravity. In this case the filling pipe 33 has an entirely vertical extent but may alternatively have a more sloping extent. When the coolant reaches the height level 37, it is led either into the first branch 34*b* and hence to the first expansion chamber 29 or into the second branch 34*c* and hence to the second expansion chamber 30.

During a coolant replenishment process, the maximum levels 40, 41 in the expansion chambers 29, 30 are not usually reached simultaneously. When for example the maximum coolant level 41 is reached in the second expansion chamber 30, the second branch 34*c* will also be full of coolant up to the inlet aperture 34*c*'. Further coolant replenishment of the second branch 34*c* is thus impossible, so all of the coolant will then be led into the first branch 34*b* and hence to the first expansion chamber 29. The coolant replenishment process continues in this way until the coolant reaches also the maximum level 38 in the first expansion chamber 29. Such an expansion tank 28 makes it possible for coolant to be replenished from a common point for two separate cooling systems A, B. The fact that the inlet apertures 34*b*', 34*c*' to the respective branches 34*b*, 34*c* are situated at the same height level 37 as the maximum levels 38, 39 for the coolant in the expansion chambers 29, 30 provides assurance that the coolant level in one expansion chamber 29, 30 cannot exceed the maximum level 38, 39 before the coolant level in the other expansion chamber 29, 30 reaches the maximum level 38, 39.

Figure 4:
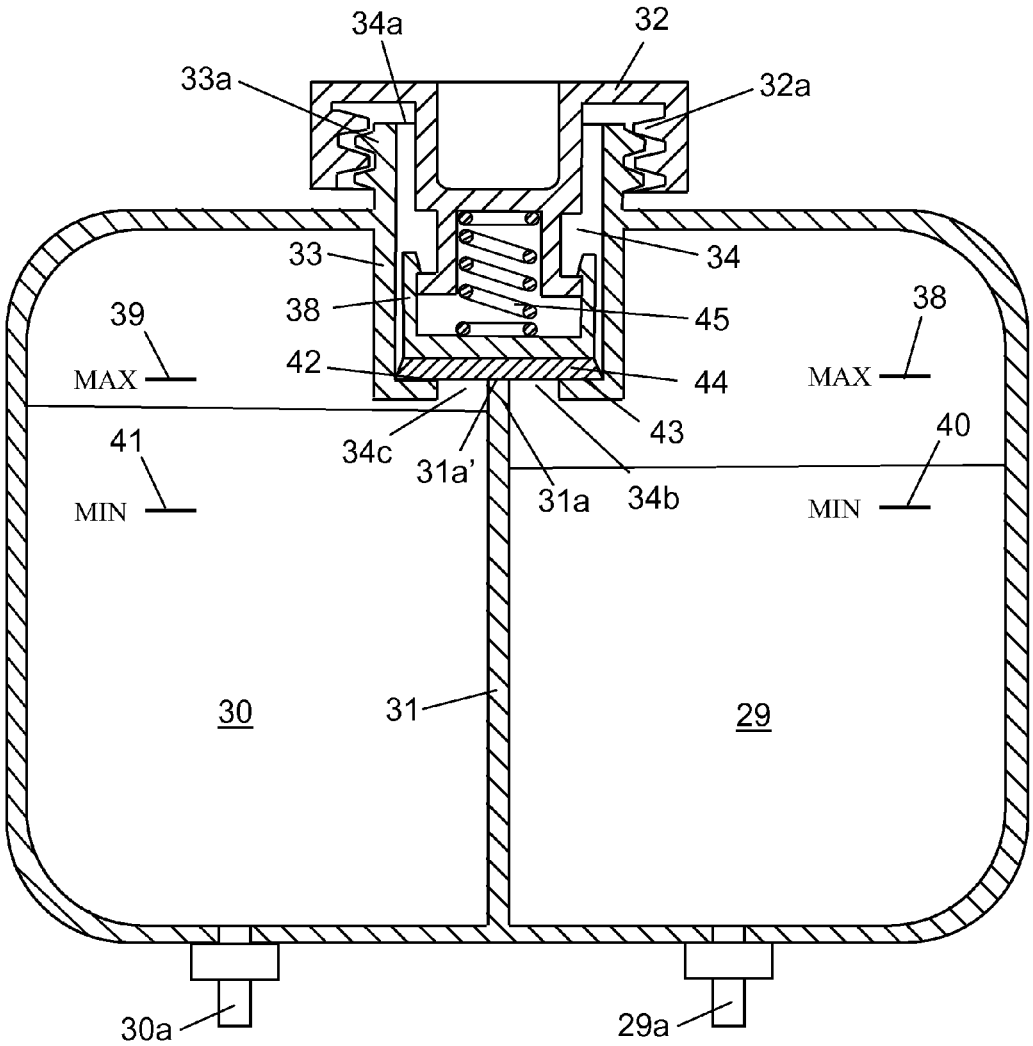
FIG 4 depicts the expansion tank in FIG 2 with the cover in a fitted state.

FIG 4 depicts the expansion tank 28 during operation of the combustion engine 2. When the cover 32 is in a fitted state, the seal element 44 abuts with a pressure force against the edge surface 31*a*' of the upper wall portion and against the contact surface 43. The result is a tight connection between the seal element 44 and the contact surfaces 31*a*', 43 which define the inlet apertures 34*b*', 34*c*' to the branches 34*b*, 34*c*. The seal element 44 thus closes the inlet apertures 33*b*', 33*c*' to the branches 33*b*, 33*c* when the cover 32 is in the fitted state. When the cover 32 is in the fitted state, the coolant is thus prevented from leaving the expansion chambers 29, 30. At the same time, the seal element 44 prevents transfer of coolant between the expansion chambers 29, 30. As the coolants in the two cooling systems A, B have different working temperatures, undesirable mixing of coolant between the different cooling systems A, B is thus prevented. The two cooling systems A, B constitute two completely separate cooling systems during operation. The contact surface 42 of the seal element 44 abuts against the contact surface 43 with a pressure force defined by the spring means 45. A highest permissible pressure can thus be maintained in the respective expansion chambers 29, 30. If the pressure in one expansion chamber 29, 30 rises to a higher pressure than the highest permissible pressure, the seal element 44 will lift from the contact surface 43 against the action of the spring means 45. A small amount of air and possibly coolant may thus pass out from the expansion chamber 29, 30. The air is led upwards in a peripheral passage between the cover 32 and the filling pipe 33 before being led out to the surroundings via passages existing between the threads 32*a* of the cover and the threads 33*a* of the filling pipe. When the excess pressure in the expansion chamber 29, 30 has been eliminated, the spring means 45 will again press the seal element 44 against the contact surfaces 31*a*', 43.

The invention is in no way limited to the embodiment to which the drawings refer but may be varied freely within the scopes of the claims. The seal element may alternatively be situated in the filling pipe and define the latter's contact surface with the cover.

The invention claimed is:

1. An expansion tank for liquid separated in two chambers of the tank, the tank comprising:

a tank body;

a filling pipe extending into the tank and forming a passage leading into the tank, the passage including an inlet aperture configured to replenish liquid of the expansion tank;

a cover configured such that in a non-fitted state, the cover leaves the passage clear and in a fitted state, the cover closes the passage;

a first expansion chamber positioned in the tank and configured to receive liquid which circulates in a first system;

a second expansion chamber positioned in the tank and configured to receive liquid which circulates in a second system;

the passage divides, at a distance from the inlet aperture, into a first branch which leads liquid to the first expansion chamber and a second branch which leads liquid to the second expansion chamber;

wherein the passage divides into the first branch and the second branch at a height level in the tank which corresponds to a maximum level for the liquid in the first expansion chamber and to a maximum level for the liquid in the second expansion chamber; and the cover comprises a closure element configured for closing the first branch and the second branch so as to prevent a movement of the liquid between the first expansion chamber and the second expansion chamber, when the cover is in the fitted state, wherein the closure element is configured to move, responsive to pressure higher than a threshold pressure in the first expansion chamber or in the second expansion chamber, from the fitted state to the non-fitted state so as to allow the movement of the liquid or air between the first expansion chamber and the second expansion chamber.

2. An expansion tank according to claim 1, further comprising a dividing wall in the tank between the first expansion chamber and the second expansion chamber.

3. An expansion tank according to claim 2, further comprising a wall portion which protrudes into the passage, the wall portion has opposite sides, so that the first branch is formed on one of the sides of the wall portion and the second branch is formed on an opposite side of the wall portion.

4. An expansion tank according to claim 3, further comprising the wall portion which divides the passage into the first branch and the second branch forms part of the dividing wall.

5. An expansion tank according to claim 1, further comprising:

at least one first contact surface of the tank, located and configured to define a first inlet aperture to the first branch and a second inlet aperture to the second branch;

the closure element comprises a second contact surface which is located and configured such that when the cover is in the fitted state, the second contact surface comes into contact with the first contact surface to define the first and the second inlet apertures.

6. An expansion tank according to claim 5, further comprising at least one seal element which defines at least one of the contact surfaces and seals the inlet apertures.

7. An expansion tank according to claim 5, wherein the closure element is configured to close at least one of the first branch and the second branch with a flexible force.

8. An expansion tank according to claim 1, wherein the liquid circulating in the first system has a working temperature during operation different from the working temperature of the liquid circulating in the second system.

9. An expansion tank according to claim 5, further comprising:

a dividing wall in the tank between the first expansion chamber and the second expansion chamber;

a wall portion which protrudes into the passage, the wall portion has opposite sides, so that the first branch is formed on one of the sides of the wall portion and the second branch is formed on an opposite side of the wall portion; and the at least one first contact surface is defined on the wall portion.

10. An expansion tank according to claim 9, further comprising the wall portion which divides the passage into the first branch and the second branch forms part of the dividing wall.

11. An expansion tank according to claim 9, further comprising a spring configured to urge the second contact surface to contact the at least one first contact surface.

12. An expansion tank according to claim 9, wherein the at least one first contact surface includes a portion of the contact element opposing the second contact surface, wherein the at least one first contact surface encloses and defines the first and second inlet apertures when contacted by the second contact surface of the closure element.

13. The expansion tank of claim 1, wherein the expansion tank is configured to hold liquid coolant in a vehicle, and the first system is configured to cool the liquid from a supercharged combustion engine of the vehicle.

* * * * *